US008845137B2

(12) United States Patent
Van De Ven et al.

(10) Patent No.: US 8,845,137 B2
(45) Date of Patent: Sep. 30, 2014

(54) LIGHTING DEVICE HAVING HEAT DISSIPATION ELEMENT

(75) Inventors: Antony Paul Van De Ven, Hong Kong (CN); Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 12/886,718

(22) Filed: Sep. 21, 2010

(65) Prior Publication Data

US 2011/0074270 A1 Mar. 31, 2011

Related U.S. Application Data

(60) Provisional application No. 61/245,685, filed on Sep. 25, 2009.

(51) Int. Cl.

| | |
|---|---|
| ***F21V 29/00*** | (2006.01) |
| ***F21K 99/00*** | (2010.01) |
| *F21V 3/00* | (2006.01) |
| *F21Y 101/02* | (2006.01) |

(52) U.S. Cl.

CPC ..... *F21V 29/004* (2013.01); *F21V 3/00* (2013.01); *F21K 9/13* (2013.01); *F21Y 2101/02* (2013.01); *F21V 29/006* (2013.01); *F21K 9/00* (2013.01)

USPC ..... 362/294; 362/373; 362/318; 362/249.01; 362/257; 362/547

(58) Field of Classification Search

CPC ..... F21S 48/328; F21S 4/00; F21V 3/00; F21V 29/006; F21V 29/248; F21V 29/30

USPC ..... 362/294, 373, 318, 249.01, 257, 547

See application file for complete search history.

(56) References Cited

U.S. PATENT DOCUMENTS

| | | | | |
|---|---|---|---|---|
| 6,623,144 | B2 * | 9/2003 | Bornhorst | 362/318 |
| 6,639,733 | B2 * | 10/2003 | Minano et al. | 359/728 |

(Continued)

FOREIGN PATENT DOCUMENTS

| | | |
|---|---|---|
| DE | 541 952 | 1/1932 |
| EP | 1 357 335 | 10/2003 |
| GB | 2 389 706 | 12/2003 |
| WO | 2007/130359 | 11/2007 |

OTHER PUBLICATIONS

U.S. Appl. No. 61/245,683, filed Sep. 25, 2009, Van de Ven et al.

*Primary Examiner* — Thomas Sember
*Assistant Examiner* — Tsion Tumebo
(74) *Attorney, Agent, or Firm* — Burr & Brown, PLLC

(57) ABSTRACT

A lighting device comprising a light source and at a heat dissipation element comprising at least first and second substantially transparent regions and at least a first fluid, at least a portion of the first fluid being positioned in a space between the transparent regions. Also, a lighting device comprising a light source, an enclosed space through which light passes and a fluid in the space. Also, a lighting device comprising a light source and heat conducting means for dissipating heat. Also, a lighting device comprising a light source and a heat dissipation element comprising first and second substantially transparent regions coupled with a space and a fluid in the space. Also, a lighting device comprising a light source and a heat dissipation element comprising a heat pipe that comprises a substantially transparent region.

42 Claims, 5 Drawing Sheets

(56) References Cited

U.S. PATENT DOCUMENTS

| | | | | |
|---|---|---|---|---|
| 7,095,110 | B2 | 8/2006 | Arik et al. | |
| 7,210,832 | B2 | 5/2007 | Huang | |
| 7,246,921 | B2 * | 7/2007 | Jacobson et al. | 362/294 |
| 2003/0214803 | A1 | 11/2003 | Ono et al. | |
| 2004/0233661 | A1 * | 11/2004 | Taylor | 362/101 |
| 2005/0041428 | A1 * | 2/2005 | Zhang | 362/294 |
| 2006/0044804 | A1 | 3/2006 | Ono et al. | |
| 2006/0196651 | A1 * | 9/2006 | Board et al. | 165/177 |
| 2006/0250802 | A1 * | 11/2006 | Herold | 362/362 |
| 2007/0139923 | A1 | 6/2007 | Negley | |
| 2007/0170447 | A1 | 7/2007 | Negley | |
| 2007/0171145 | A1 | 7/2007 | Coleman | |
| 2007/0236911 | A1 | 10/2007 | Negley | |
| 2007/0236935 | A1 * | 10/2007 | Wang | 362/294 |
| 2007/0263393 | A1 | 11/2007 | Van de Ven | |
| 2007/0274063 | A1 | 11/2007 | Negley | |
| 2007/0274080 | A1 | 11/2007 | Negley | |
| 2007/0278934 | A1 | 12/2007 | Van de Ven | |
| 2007/0279440 | A1 | 12/2007 | Negley | |
| 2007/0279903 | A1 | 12/2007 | Negley | |
| 2007/0280624 | A1 | 12/2007 | Negley | |
| 2008/0013316 | A1 * | 1/2008 | Chiang | 362/264 |
| 2008/0084685 | A1 | 4/2008 | Van de Ven | |
| 2008/0084700 | A1 | 4/2008 | Van de Ven | |
| 2008/0084701 | A1 | 4/2008 | Van de Ven | |
| 2008/0088248 | A1 | 4/2008 | Myers | |
| 2008/0089053 | A1 | 4/2008 | Negley | |
| 2008/0106895 | A1 | 5/2008 | Van de Ven | |
| 2008/0106907 | A1 | 5/2008 | Trott | |
| 2008/0112168 | A1 | 5/2008 | Pickard | |
| 2008/0112170 | A1 | 5/2008 | Trott | |
| 2008/0112183 | A1 | 5/2008 | Negley | |
| 2008/0130298 | A1 | 6/2008 | Negley | |
| 2008/0137347 | A1 | 6/2008 | Trott | |
| 2008/0278950 | A1 | 11/2008 | Pickard | |
| 2008/0278952 | A1 | 11/2008 | Trott | |
| 2008/0278957 | A1 | 11/2008 | Pickard | |
| 2008/0304249 | A1 | 12/2008 | Davey et al. | |
| 2008/0304261 | A1 | 12/2008 | Van de Ven | |
| 2008/0304269 | A1 | 12/2008 | Pickard | |
| 2008/0309255 | A1 | 12/2008 | Myers | |
| 2009/0001372 | A1 * | 1/2009 | Arik et al. | 257/58 |
| 2009/0095960 | A1 | 4/2009 | Murayama | |
| 2009/0108269 | A1 | 4/2009 | Negley | |
| 2009/0161356 | A1 | 6/2009 | Negley | |
| 2009/0184662 | A1 | 7/2009 | Given | |
| 2009/0184666 | A1 | 7/2009 | Myers | |
| 2009/0290349 | A1 * | 11/2009 | Chu et al. | 362/249.02 |
| 2009/0309473 | A1 * | 12/2009 | Lenk et al. | 313/46 |
| 2010/0020532 | A1 | 1/2010 | Negley | |
| 2010/0102199 | A1 | 4/2010 | Negley | |
| 2010/0102697 | A1 | 4/2010 | Van de Ven | |
| 2010/0103678 | A1 | 4/2010 | Van de Ven | |
| 2010/0290222 | A1 | 11/2010 | Pickard | |

* cited by examiner

LIGHTING DEVICE HAVING HEAT DISSIPATION ELEMENT

CROSS-REFERENCE TO RELATED APPLICATIONS

This application claims the benefit of U.S. patent application Ser. No. 61/245,685, filed Sep. 25, 2009, the entirety of which is incorporated herein by reference.

FIELD OF THE INVENTIVE SUBJECT MATTER

The present inventive subject matter relates to a lighting device that has at least one heat dissipation element and/or at least one heat dissipation means. In some embodiments, the present inventive subject matter relates to a lighting device that includes one or more solid state light emitting devices, e.g., one or more light emitting diodes.

BACKGROUND

There are a wide variety of light sources in existence, e.g., incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc. The various types of light sources have been provided in a variety of shapes, sizes and arrangements, e.g., A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc. The various types of light sources have been supplied with energy in various ways, e.g., with an Edison connector, a battery connection, a GU-24 connector, direct wiring to a branch circuit, etc. The various types of light sources have been designed so as to serve any of a variety of functions (e.g., as a flood light, as a spotlight, as a downlight, etc.), and have been used in residential, commercial or other applications.

With many light sources, there is a desire to effectively dissipate heat produced in generating light.

For example, with many incandescent light sources, about ninety percent of the electricity consumed is released as heat rather than light. There are many situations where effective heat dissipation is needed or desired for such incandescent light sources.

Solid state light emitters (e.g., light emitting diodes) are receiving much attention due to their energy efficiency. A challenge with solid state light emitters is that many solid state light emitters do not operate as well as possible when they are subjected to elevated temperatures. For example, many light emitting diode light sources have average operating lifetimes of decades (as opposed to just months or 1-2 years for many incandescent bulbs), but some light emitting diodes' lifetimes can be significantly shortened if they are operated at elevated temperatures. A common manufacturer recommendation is that the junction temperature of a light emitting diode should not exceed 70 degrees C. if a long lifetime is desired.

In addition, the intensity of light emitted from some solid state light emitters can vary based on ambient temperature. For example, light emitting diodes that emit red light often have a very strong temperature dependence (e.g., AlInGaP light emitting diodes can reduce in optical output by ~20% when heated up by ~40 degrees C., that is, approximately −0.5% per degree C.; and blue InGaN+YAG:Ce light emitting diodes can reduce by about −0.15%/degree C.). In many lighting devices that include solid state light emitters as light sources (e.g., general illumination devices that emit white light in which the light sources consist of light emitting diodes), a plurality of solid state light emitters are provided that emit light of different colors which, when mixed, are perceived as the desired color for the output light (e.g., white or near-white). The desire to maintain a relatively stable color of light output is therefore an important reason to try to reduce temperature variation of solid state light emitters.

In some cases (e.g., most residential applications), fixtures (e.g., "cans") are required to be substantially airtight around the sides and top to prevent the loss of ambient heat or cooling from the room into the ceiling cavity through the fixture. As the lamp is mounted in the can, much of the heat generated by the light source is trapped within the can, because the air heated in the can rises and is trapped within the can. Insulation is usually required around the can within the ceiling cavity to further reduce heat loss or cooling loss from the room into the ceiling cavity.

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

Because light that is perceived as white is necessarily a blend of light of two or more colors (or wavelengths), no single light emitting diode junction has been developed that can produce white light.

"White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by light emitted by the light emitting diode, whereby the blue light and the yellow light, when mixed, produce light that is perceived as white light. While there is a need for more efficient white lighting, there is in general a need for more efficient lighting in all hues.

BRIEF SUMMARY OF THE INVENTIVE SUBJECT MATTER

In one aspect, the present inventive subject matter provides a heat dissipation element.

In another aspect, the present inventive subject matter provides a heat dissipation element that comprises at least first and second substantially transparent regions and at least a first fluid, at least a first space being defined between the first substantially transparent region and the second substantially transparent region, at least a portion of the first fluid being positioned in the first space.

In another aspect, the present inventive subject matter provides a lighting device that comprises at least a first light source and at least a first heat dissipation element. In this aspect, the first heat dissipation element comprises at least first and second substantially transparent regions and at least a first fluid, at least a first space being defined between the first substantially transparent region and the second substantially transparent region, at least a portion of the first fluid being positioned in the first space.

In another aspect, the present inventive subject matter provides a lighting device that comprises at least a first light source, at least a first enclosed space through which at least some light emitted by the first light source passes, and at least a first fluid positioned in the first enclosed space. In this aspect, at least a first portion of the first fluid is liquid, and at least a second portion of the first fluid is gaseous.

In some embodiments, the present inventive subject matter provides a heat dissipation element that is a heat pipe for use in a lighting device (and a lighting device that includes such a heat pipe), in which at least part of the heat pipe is substantially transparent so that light can pass through the heat pipe. Heat pipes use a generally adiabatic process to transfer heat from one location to another. In particular, the energy used to transfer a fluid from one state into a second state is stored in the fluid, which flows to a remote location. The heat is released in transitioning from the second state to the first state in the remote location. For example, heat can be applied to the fluid in a first region, where the fluid becomes vaporized, thereby absorbing the latent heat of vaporization, and the vaporized fluid then flows to a second region, where the fluid condenses and gives up the latent heat of vaporization. The pressure within the space in which the fluid is positioned can be selected (typically a reduced pressure, i.e, a partial vacuum) so as to enable the fluid to change state (liquid to gas and gas to liquid) at the temperatures in the regions where it is desired for such change of state to occur. Typically, such devices employ a metal pipe and water as the fluid (which changes state between liquid and gas). Metal pipes, however, are opaque, and would obstruct light if placed in the path of light being emitted by one or more light sources in a lighting device.

In accordance with some embodiments of the present inventive subject matter, a heat pipe is provided in which at least portions of the heat pipe are substantially transparent. Such heat pipes are employed in some embodiments of lighting devices according to the present inventive subject matter, whereby light emitted by one or more light sources in the lighting devices can travel through the heat pipe (at least through portions thereof), and the heat pipes provide excellent heat dissipation.

In another aspect, the present inventive subject matter relates to a lighting device comprising at least a first light source and at least a first heat dissipation element comprising at least first and second substantially transparent regions and at least a first fluid, at least a first space being thermally coupled with the first substantially transparent region and the second substantially transparent region, at least a portion of the first fluid being positioned in the first space.

The inventive subject matter may be more fully understood with reference to the accompanying drawings and the following detailed description of the inventive subject matter.

BRIEF DESCRIPTION OF THE DRAWING FIGURES

FIGS. 1-2 illustrate a lighting device 10 in accordance with the present inventive subject matter. FIG. 1 is a front view of the lighting device 10. FIG. 2 is a sectional view of the lighting device 10 taken along the plane 2-2.

FIGS. 3-5 illustrate a lighting device 20 in accordance with the present inventive subject matter. FIG. 3 is a top view of the lighting device 20. FIG. 4 is a perspective view of the lighting device 20. FIG. 5 is a cross-sectional view taken along the plane 5-5 shown in FIG. 3.

FIGS. 6-7 illustrate a lighting device 60 in accordance with the present inventive subject matter. FIG. 6 is a top view of the lighting device 60. FIG. 7 is a sectional view of the lighting device 60 taken along the plane 7-7.

DETAILED DESCRIPTION OF THE INVENTIVE SUBJECT MATTER

Figure 1:
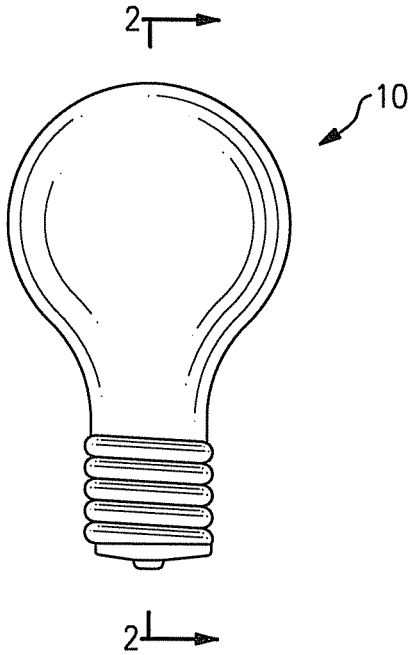

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items. All numerical quantities described herein are approximate and should not be deemed to be exact unless so stated.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is in "direct contact" with a second structure is touching the second structure and there are no intervening structures between the first and second structures at least at some location.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary twins "below" or "beneath" can, therefore, encompass both an orientation of above and below.

The term "illumination" (or "illuminated"), as used herein means that a light source is emitting electromagnetic radiation. For example, when referring to a solid state light emitter, the term "illumination" means that at least some current is being supplied to the solid state light emitter to cause the solid state light emitter to emit at least some electromagnetic radiation (in some cases, with at least a portion of the emitted radiation having a wavelength between 100 nm and 1000 nm, and in some cases within the visible spectrum). The expression "illuminated" also encompasses situations where the light source emits light continuously or intermittently at a rate such that if it is or was visible light, a human eye would perceive it as emitting light continuously (or discontinuously), or where a plurality of light sources (especially in the case of solid state light emitters) that emit light of the same color or different colors are emitting light intermittently and/or alternatingly (with or without overlap in "on" times) in such a way that if they were or are visible light, a human eye would perceive them as emitting light continuously or discontinuously (and, in cases where different colors are emitted, as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The expression "substantially transparent", as used herein, means that the structure that is characterized as being substantially transparent allows passage of at least 90% of incident visible light.

The expression "thermally coupled", as used herein, means that heat transfer occurs between (or among) the two (or more) items that are thermally coupled. Such heat transfer encompasses any and all types of heat transfer, regardless of how the heat is transferred between or among the items. That is, the heat transfer between (or among) items can be by conduction, convection, radiation, or any combinations thereof, and can be directly from one of the items to the other, or indirectly through one or more intervening elements or spaces (which can be solid, liquid and/or gaseous) of any shape, size and composition. The expression "thermally coupled" encompasses structures that are "adjacent" (as defined herein) to one another. In some situations/embodiments, the majority of the heat transferred from the light source is transferred by conduction; in other situations/embodiments, the majority of the heat that is transferred from the light source is transferred by convection; and in some situations/embodiments, the majority of the heat that is transferred from the light source is transferred by a combination of conduction and convection.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

According to an aspect of the present inventive subject matter, there is provided a heat dissipation element.

According to an aspect of the present inventive subject matter, there is provided a lighting device comprising at least a first heat dissipation element.

According to an aspect of the present inventive subject matter, there is provided a lighting device comprising at least one light source and at least a first heat dissipation element.

Each of the one or more light sources can be selected from among any or all of the wide variety of light sources known to persons of skill in the art. Representative examples of types of light sources include incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc., each with or without one or more filters. That is, the at least one light source can comprise a single light source, a plurality of light sources of a particular type, or any combination of one or more light sources of each of a plurality of types.

A variety of solid state light emitters are well known, and any of such light emitters can be employed according to the present inventive subject matter. Representative examples of solid state light emitters include light emitting diodes (inorganic or organic, including polymer light emitting diodes (PLEDs)) with or without luminescent materials.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

A luminescent material is a material that emits a responsive radiation (e.g., visible light) when excited by a source of exciting radiation. In many instances, the responsive radiation has a wavelength which is different from the wavelength of the exciting radiation.

Luminescent materials can be categorized as being down-converting, i.e., a material which converts photons to a lower energy level (longer wavelength) or up-converting, i.e., a material which converts photons to a higher energy level (shorter wavelength).

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

One type of luminescent material are phosphors, which are readily available and well known to persons of skill in the art. Other examples of luminescent materials include scintillators, day glow tapes and inks which glow in the visible spectrum upon illumination with ultraviolet light.

The advantage of providing a wider spectrum of visible wavelengths to provide increased CRI (e.g., Ra) is well known, and the ability to predict the perceived color of output light from a lighting device which includes light emitters which output two or more respective colors of light is also well known, e.g., with the assistance of the CIE color charts.

Luminescent material (when included) can be provided in any suitable form. For example, the luminescent element can be embedded in the heat dissipation element and/or in a resin (i.e., a polymeric matrix), such as a silicone material, an epoxy material, a glass material or a metal oxide material. The luminescent material can be contained in an encapsulant in which one or more light source (e.g., a light emitting diode) is embedded.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009-0108269), the entirety of which is hereby incorporated by reference as if set forth in its entirety.

Each of the one or more light sources can be of any suitable shape, a variety of which are known to those of skill in the art, e.g., in the shape of an A lamp, a B-10 lamp, a BR lamp, a C-7 lamp, a C-15 lamp, an ER lamp, an F lamp, a G lamp, a K lamp, an MB lamp, an MR lamp, a PAR lamp, a PS lamp, an R lamp, an S lamp, an S-11 lamp, a T lamp, a Linestra 2-base lamp, an AR lamp, an ED lamp, an E lamp, a BT lamp, a Linear fluorescent lamp, a U-shape fluorescent lamp, a circline fluorescent lamp, a single twin tube compact fluorescent lamp, a double twin tube compact fluorescent lamp, a triple twin tube compact fluorescent lamp, an A-line compact fluorescent lamp, a screw twist compact fluorescent lamp, a globe screw base compact fluorescent lamp, or a reflector screw base compact fluorescent lamp. Lighting devices according to the present inventive subject matter can comprise one or more light sources of a particular shape or one or more light sources of each of a plurality of different shapes.

Each of the one or more light sources can be designed to emit light in any suitable pattern, e.g., in the form of a flood light, a spotlight, a downlight, etc. Lighting devices according to the present inventive subject matter can comprise one or more light sources that emit light in any suitable pattern, or one or more light sources that emit light in each of a plurality of different patterns.

The lighting devices according to some embodiments of the present inventive subject matter comprise one or more heat dissipation elements that comprise at least first and second substantially transparent regions and at least a first fluid, at least a first space being defined between the first substantially transparent region and the second substantially transparent region, at least a portion of the first fluid being positioned in the first space.

Although the first space is defined between the first substantially transparent region and the second substantially transparent region, the space is not necessarily completely surrounded by the combination of the first substantially transparent region and the second substantially transparent region.

The pressure within the space in which the fluid is positioned can be selected (typically a reduced pressure, i.e, a partial vacuum) so as to enable the fluid to change state (liquid to gas and gas to liquid) at the temperatures in the regions within the space where it is desired for such change of state to occur, i.e., so that the heat dissipation element (or elements) functions as a heat pipe, in the sense that heat is transported from a first location (or locations) to a second location (or locations) by vaporization at the first location (or at least one of the first locations), movement of the resulting gas to the second location (or at least one of the second locations), condensation of the gas at the second location (or at least one of the second locations), and movement of the resulting liquid back to the first location (or at least one of the first locations).

Each substantially transparent region in the lighting device independently can be formed of any suitable substantially transparent material, a wide variety of which are well known and readily available. Representative examples of materials that a substantially transparent region can comprise include sintered silicon carbide, diamond, glass, polymeric material and ceramic material (such as alumina) with sub-micron particle size.

Sintered silicon carbide (including sintered mixtures that contain silicon carbide and other materials), is described in U.S. patent application Ser. No. 61/245,683, filed on Sep. 25, 2009 and in PCT Application No. PCT/US 10/49560 (now PCT Publication No. WO 2011/037876), entitled "Lighting Device Having Heat Dissipation Element", filed Sep. 21, 2010, the entireties of which are hereby incorporated by reference as if set forth in their entireties. If employed, sintered silicon carbide can provide heat dissipation elements that have high strength, high hardness, high stiffness, structural integrity, good polishability and good thermal stability. Sintered silicon carbide can be fabricated and machined into a desired shape, and can therefore provide excellent structural support for a lighting device, as well as excellent thermal conductivity.

In the case of light sources that comprise one or more solid state light emitters, sintered silicon carbide can have a thermal expansion coefficient that is closely matched to that of silicon carbide-based semiconductor devices. Accordingly, in such light sources, the rate of incidence of failures that might otherwise result from differing rates of thermal expansion can be reduced or avoided.

The use of one or more heat dissipation elements as described herein is particularly well suited for lighting devices that comprise one or more solid state light emitters, as such light emitters typically benefit from the use of structural parts that also conduct heat effectively (i.e., that have high thermal conductivity) in order to dissipate heat from the light sources (e.g., light emitting diodes) so as to maintain junction temperatures within acceptable ranges. Such properties are especially valuable with respect to devices in which the surface area from which heat can be dissipated is limited. In addition, by providing lighting devices in which at least a portion of a heat dissipation element is transparent or substantially transparent, if the heat dissipation element is in the path of at least some of the light emitted by the one or more light source, the heat dissipation element can allow for more light to exit the lighting device (i.e., less light is absorbed or reflected by the heat dissipation element) than would otherwise be the case if the entirety of the heat dissipation element were opaque, while the heat dissipation element is still capable of conducting a desired amount of heat away from the light source(s).

The at least one heat dissipation element can be of any suitable shape and size, and persons of skill in the art can readily envision a wide variety of such shapes and sizes depending on the overall shape and size of the lighting device in which the heat dissipation element(s) are being employed, as well as the shape and size of individual components included in the lighting device.

For example, in some embodiments according to the present inventive subject matter, including some embodiments that include or do not include any of the features as discussed herein, the heat dissipation element (or one or more of the heat dissipation elements) can be (or can comprise a portion that is) hollow substantially cylindrical (i.e., in a "pipe-like" configuration).

In some embodiments according to the present inventive subject matter, including some embodiments that include or do not include any of the features as discussed herein, the heat dissipation element (or one or more of the heat dissipation elements) can be (or can comprise a portion or portions that is/are) in the form of layers (which can be concentric or stacked, or not) of geometric shapes in two- or three-dimensional arrangements, including but not limited to substantially cylindrical, substantially spherical, substantially cube-shaped, etc., with fluid being provided between respective substantially transparent layers.

The expression "substantially spherical" means that a sphere can be drawn having the formula $x^2+y^2+z^2=n$, where imaginary axes can be drawn at a location where for each of at least 80% of the points on a surface of the structure being characterized as "substantially spherical", the z coordinate is within 0.95 to 1.05 times the value obtained by inserting the x and y coordinates of each such point into such formula.

The expression "substantially cube-shaped" means that a cube could be drawn where at least 80% of the points on a surface of the structure being characterized as "substantially cube-shaped" would fall on such cube.

In some embodiments according to the present inventive subject matter, including some embodiments that include or do not include any of the features as discussed herein, the heat dissipation element (or one or more of the heat dissipation elements) can be (or can comprise a portion that is) substantially cylindrical, substantially disc-shaped or substantially bulb-shaped.

The expression "substantially cylindrical", as used herein, means that at least 95% of the points in the surface which is characterized as being substantially cylindrical are located on one of or between a pair of imaginary cylindrical structures which are spaced from each other by a distance of not more than 5% of their largest dimension.

The expression "substantially disc-shaped", as used herein, means a structure that is substantially cylindrical (as defined above), where the axial dimension of the structure is less than the radial dimension of the structure.

The expression "substantially bulb-shaped", as used herein, means a structure that includes at least a first portion that is substantially cylindrical and at least a second portion that extends diametrically in a direction perpendicular to an axis of the substantially cylindrical portion farther than the substantially cylindrical portion, including (but not limited to) shapes that correspond to A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, AR lamps, ED lamps, E lamps, BT lamps, A-line compact fluorescent lamps, globe screw base compact fluorescent lamps, reflector screw base compact fluorescent lamps, etc.

For example, in accordance with the present inventive subject matter, the heat dissipation element (or one or more of the heat dissipation elements) can have a shape and size that corresponds to a heat dissipation element in any other lighting device, such as:

- a bridge on which one or more light sources are mounted, as described in U.S. patent application Ser. No. 12/469,819, filed on May 21, 2009 (now U.S. Patent Publication No. 2010-0102199), the entirety of which is hereby incorporated by reference as if set forth in its entirety,
- a bridge on which one or more light sources are mounted, as described in U.S. patent application Ser. No. 12/467,467, filed on May 18, 2009 (now U.S. Patent Publication No. 2010/0290222), the entirety of which is hereby incorporated by reference as if set forth in its entirety;
- a bridge on which one or more light sources are mounted, as described in U.S. patent application Ser. No. 12/469,828, filed on May 21, 2009 (now U.S. Patent Publication No. 2010-0103678), the entirety of which is hereby incorporated by reference as if set forth in its entirety;
- an "S" shaped heat pipe on which one or more light sources are mounted, as described in U.S. patent application Ser. No. 12/469,828, filed on May 21, 2009 (now U.S. Patent Publication No. 2010-0103678);
- a lens that covers (partially or completely) an opening through which light is emitted, e.g., a back-reflector as described in U.S. patent application Ser. No. 12/469,828, filed on May 21, 2009 (now U.S. Patent Publication No. 2010-0103678).

In accordance with the present inventive subject matter, the heat dissipation element (or one or more of the heat dissipation elements) can have a shape and size that corresponds to the bulb portion (or a portion thereof) of any lighting device, such as: an A lamp, a B-10 lamp, a BR lamp, a C-7 lamp, a C-15 lamp, an ER lamp, an F lamp, a G lamp, a K lamp, an MB lamp, an MR lamp, a PAR lamp, a PS lamp, an R lamp, an S lamp, an S-11 lamp, a T lamp, a Linestra 2-base lamp, an AR lamp, an ED lamp, an E lamp, a BT lamp, a Linear fluorescent lamp, a U-shape fluorescent lamp, a circline fluorescent lamp, a single twin tube compact fluorescent lamp, a double twin tube compact fluorescent lamp, a triple twin tube compact fluorescent lamp, an A-line compact fluorescent lamp, a screw twist compact fluorescent lamp, a globe screw base compact fluorescent lamp, or a reflector screw base compact fluorescent lamp.

In accordance with the present inventive subject matter, the heat dissipation element (or one or more of the heat dissipation elements) can constitute the bulb portion, or can constitute one or more parts of the bulb portion, of any lighting device, such as: an A lamp, a B-10 lamp, a BR lamp, a C-7 lamp, a C-15 lamp, an ER lamp, an F lamp, a G lamp, a K lamp, an MB lamp, an MR lamp, a PAR lamp, a PS lamp, an R lamp, an S lamp, an S-11 lamp, a T lamp, a Linestra 2-base lamp, an AR lamp, an ED lamp, an E lamp, a BT lamp, a Linear fluorescent lamp, a U-shape fluorescent lamp, a circline fluorescent lamp, a single twin tube compact fluorescent lamp, a double twin tube compact fluorescent lamp, a triple twin tube compact fluorescent lamp, an A-line compact fluorescent lamp, a screw twist compact fluorescent lamp, a globe screw base compact fluorescent lamp, or a reflector screw base compact fluorescent lamp.

In some embodiments according to the present inventive subject matter, including some embodiments that include or do not include any of the features as discussed herein, at least a first cross-section of the first heat dissipation element (or one or more of the heat dissipation elements) comprises an inner substantially annular shape and an outer substantially annular shape, the inner substantially annular portion being surrounded by the outer substantially annular portion. The expression "substantially annular", as used herein, means a structure that extends around an unfilled region, and which can otherwise be of any general shape, and any cross-sections can be of any shape. For example, "annular" encompasses ring-like shapes which can be defined by rotating a circle about an axis in the same plane as, but spaced from, the circle. "Annular" likewise encompasses shapes which can be defined by rotating a square (or any other two-dimensional shape) about an axis in the same plane as, but spaced from, the square. "Annular" likewise encompasses shapes that can be defined by moving any shape from a first position, through space along any path without ever moving to a position where part of the shape occupies a space previously occupied by any part of the shape, and eventually returning to the first position. "Annular" likewise encompasses shapes that can be defined by moving any shape from a first position, through space along any path without ever moving to a position where part of the shape occupies a space previously occupied by any part of the shape, and eventually returning to the first position, and where the shape and size of the shape being moved can be altered at any time, and any number of times, during its movement.

In some embodiments according to the present inventive subject matter, including some embodiments that include or do not include any of the features as discussed herein, a shape of an inner periphery of the first substantially transparent region is substantially similar to a shape of an outer periphery of the second substantially transparent region. A statement herein that a first shape is substantially similar to a second shape, e.g., in the expression "a shape of an inner periphery of the first substantially transparent region is substantially similar to a shape of an outer periphery of the second substantially transparent region" means that for at least 75% of the points on the smaller shape, a distance between such point and a nearest point on the largest shape is within 20% of an average distance.

In some embodiments according to the present inventive subject matter, including some embodiments that include or do not include any of the features as discussed herein, a first surface of the first substantially transparent region is substantially planar and substantially parallel to a first surface of the second substantially transparent region.

The expression "substantially planar" means that at least 90% of the points in the surface which is characterized as being substantially planar are located on one of or between a pair of planes which are parallel and which are spaced from each other by a distance of not more than 5% of the largest dimension of the surface.

The expression "substantially parallel" means that two lines (or two planes) diverge from each other at most by an angle of 5% of 90 degrees, i.e., 4.5 degrees.

In some embodiments according to the present inventive subject matter, including some embodiments that include or do not include any of the features as discussed herein, at least a first cross-section of the first heat dissipation element is substantially annular.

In some embodiments according to the present inventive subject matter, including some embodiments that include or do not include any of the features as discussed herein, one or more surfaces of the one or more heat dissipation element(s) (e.g., at least the first substantially transparent region, or at least the first and second substantially transparent regions) that the fluid contacts is textured, grooved or roughened, or treated or shaped in any way to assist in moving liquefied fluid back to the region(s) where it is vaporized (e.g., to provide capillary action to wick the liquid, to be made to be hydrophillic and/or to have affinity, e.g., by electrical, magnetic or chemical means, such as oxide treatment).

In some embodiments according to the present inventive subject matter, the heat dissipation element (or one or more of the heat dissipation elements) can comprise (a) one or more region that comprises at least first and second substantially transparent regions and at least a first fluid, and (b) one or more regions or structures of high heat conducting capability (e.g., one or more wires, bars, layers, particles, regions and/or slivers made of a material that is a good conductor of heat, e.g., having a heat conductivity of at least 1 W/m-K). In such embodiments, the heat dissipation element(s) and any other regions can be of any sub-shapes in relation to the overall shape of the structure in which they are contained, e.g., where the overall shape is of a disc, the sub-shapes can be vertical slices (like pie slices), horizontal slices (i.e., to form stacked discs), etc.

Some embodiments according to the present inventive subject matter can further comprise one or more heat spreader. A heat spreader typically has a heat conductivity that is higher than the heat conductivity of the substantially transparent heat sink. For example, in some embodiments of the present inventive subject matter, a heat spreader is provided in order for heat to be spread out into a larger surface area from which it can be dissipated through the heat dissipation element(s) and/or other structure. Representative examples of materials out of which a heat spreader (if provided) can be made include copper, aluminum, diamond and DLC. A heat spreader (if provided) can be of any suitable shape. Use of materials having higher heat conductivity in making heat spreaders generally provides greater heat transfer, and use of heat spreaders of larger surface area and/or cross-sectional area generally provides greater heat transfer, but might block the passage of more light. Representative examples of shapes in which the heat spreaders, if provided, can be formed include bars (e.g., diametrical or cantilevered across an aperture), crossbars, wires and/or wire patterns. Heat spreaders, if included, can also function as one or more electrical terminals for carrying electricity, if desired.

The heat dissipation element (or one or more of the heat dissipation elements) can consist of a single heat dissipation structure, or it can comprise a plurality of heat dissipation structures.

The heat dissipation element (or one or more of the heat dissipation elements) can be of a shape that refracts light, for example a shape that refracts light in many complicated ways. With any of the lighting devices according to the present inventive subject matter, particularly those that include one or more heat dissipation elements that refract light in complicated ways, persons of skill in the art are familiar with experimenting with and adjusting light refracting shapes so as to achieve desired light focusing, light directing, and/or light mixing properties, including mixing of light of differing hues.

The heat dissipation element (or one or more of the heat dissipation elements) can, if desired, include one or more optical features formed on its surface and/or within. As used herein, the expression "optical feature" refers to a three dimensional shape that has a contour that differs from the contour of the immediate surroundings, or to a pattern of shapes that has a contour that differs from the contour of the immediate surrounding. The size of such contour can be nano, micro, or macro in size or scale. A pattern of optical features can be any suitable pattern for providing a desired diffusion and/or mixing of light. The pattern can be repeating, pseudo-random or random. The expression "pseudo-random" means a pattern that includes one or more types of random sub-patterns which are repeated. The expression "random" means a pattern that does not include any substantial regions which are repeated. Persons of skill in the art are familiar with a wide variety of optical features as defined herein, and any such optical features can be employed in the lighting devices according to the present inventive subject matter.

In some embodiments according to the present inventive subject matter, including some embodiments that include or do not include any of the features as discussed herein, substantially all light emitted by the first light source that exits the lighting device passes through at least a portion of the first heat dissipation element (or through at least a portion of one of a plurality of heat dissipation elements).

The expression "substantially all", as used herein, means at least 90%, in some instances at least 95%, in some instances at least 99%, and in some instances at least 99.9%.

In some embodiments according to the present inventive subject matter, including some embodiments that include or do not include any of the features as discussed herein, substantially all of the first heat dissipation element is substantially transparent.

In some embodiments according to the present inventive subject matter, including some embodiments that include or do not include any of the features as discussed herein, the first light source is in direct contact with only the first heat dissipation element and at least one power line. A power line can be any structure that is configured for supplying energy to the light source, e.g., a wire, a conductive trace, etc. A power line can be positioned in any suitable way in the lighting devices according to the present inventive subject matter, e.g., on a surface of (or within) a heat dissipation element, along or through a housing, etc.

In some embodiments according to the present inventive subject matter, including some embodiments that include or do not include any of the features as discussed herein, the first heat dissipation element comprises an inner wall and an outer wall, and at least a portion of the first space is positioned between the inner wall and the outer wall.

In some embodiments according to the present inventive subject matter, including some embodiments that include or do not include any of the features as discussed herein, the first light source is mounted on a support, and the support is in direct contact with only the one or more light sources and the heat dissipation element.

In some embodiments according to the present inventive subject matter, including some embodiments that include or do not include any of the features as discussed herein, the lighting device further comprises at least a first reflector, and at least some light emitted by the first light source that exits the lighting device is reflected by the first reflector before exiting the lighting device.

In some embodiments according to the present inventive subject matter, including some embodiments that include or do not include any of the features as discussed herein, the lighting device further comprises at least a first back-reflector, and substantially all light emitted by the first light source that exits the lighting device is reflected before exiting the lighting device. In some of such embodiments:

- the first back-reflector defines an aperture from which light exiting the lighting device exits, and the first heat dissipation element extends across the aperture from a first portion of the first back-reflector to a second portion of the first back-reflector (and in some of these embodiments, the aperture is substantially circular, and the first heat dissipation element is substantially diametrical relative to the aperture), and/or
- the heat dissipation element covers part or all of the aperture, and/or
- the first back-reflector comprises a plurality of reflective elements.

The expression "substantially circular" means that a circle can be drawn having the formula $x^2+y^2=1$, where imaginary axes can be drawn at a location where for each of at least 80% of the points on the feature being characterized as "substantially circular", the y coordinate is within 0.95 to 1.05 times the value obtained by inserting the x coordinate of such point into such formula.

The expression "substantially diametrical" means that at least 95% of the points in the structure that is characterized as being "substantially diametrical" relative to a circle or a substantially circular structure fall within a line segment (or rectangle) that bisects the circle (or the substantially circular structure) and comprise at least 70% of the points along the line segment (or rectangle).

In some embodiments according to the present inventive subject matter, including some embodiments that include or do not include any of the features as discussed herein, an axis of at least a portion of the space defines an angle of not more than 70 degrees relative to an emission plane of the first light source.

The expression "emission plane" (e.g., "an emission plane of the first light source"), as used herein, means (1) a plane that is perpendicular to an axis of the light emission from the light source (e.g., in a case where light emission is hemispherical, the plane would be along the flat part of the hemisphere; in a case where light emission is conical, the plane would be perpendicular to the axis of the cone), (2) a plane that is perpendicular to a direction of maximum intensity of light emission from the light source (e.g., in a case where the maximum light emission is vertical, the plane would be horizontal), or (3) a plane that is perpendicular to a mean direction of light emission (in other words, if the maximum intensity is in a first direction, but an intensity in a second direction ten degrees to one side of the first direction is larger than an intensity in a third direction ten degrees to an opposite side of the first direction, the mean intensity would be moved some-what toward the second direction as a result of the intensities in the second direction and the third direction).

In some embodiments according to the present inventive subject matter, including some embodiments that include or do not include any of the features as discussed herein, the first heat dissipation element (or one or more of the heat dissipation elements) comprises at least one opaque region. The term "opaque", as used herein, means that the structure (or region of a structure) that is characterized as being opaque allows passage of less than 90% of incident visible light.

In some embodiments according to the present inventive subject matter, including some embodiments that include or do not include any of the features as discussed herein, the first heat dissipation element (or one or more of the heat dissipation elements) comprises at least a first reflective region. The term "reflective", as used herein, means that the structure (or region of a structure) that is characterized as being reflective reflects at least 50% of incident visible light.

In some embodiments according to the present inventive subject matter, including some embodiments that include or do not include any of the features as discussed herein, at least a first region of the first heat dissipation element (or one or more of the heat dissipation elements), e.g., at least one of the first and second substantially transparent regions, further comprises at least one material selected from among scattering agents (a variety of which are well known) and luminescent materials.

The present inventive subject matter is also directed to a lighting device that comprises at least a first light source (which can be any light source as described herein), at least a first enclosed space through which at least some light emitted by the first light source passes, and at least a first fluid positioned in the first enclosed space. In this aspect, at least a first portion of the first fluid is liquid, and at least a second portion of the first fluid is gaseous. In this aspect, the enclosed space can be defined by any structure suitable for holding the gaseous first fluid and the liquid first fluid. In some embodiments, the enclosed space and the first fluid can be part of any of the heat dissipation elements as described herein.

The present inventive subject matter is also directed to a lighting device comprising at least a first light source and means for dissipating heat.

The present inventive subject matter is also directed to a light fixture that comprises at least one lighting device as described herein. The light fixture can comprise a housing, a mounting structure, and/or an enclosing structure. Persons of skill in the art are familiar with, and can envision, a wide variety of materials out of which a fixture, a housing, a mounting structure and/or an enclosing structure can be constructed, and a wide variety of shapes for such a fixture, a housing, a mounting structure and/or an enclosing structure. A fixture, a housing, a mounting structure and/or an enclosing structure made of any of such materials and having any of such shapes can be employed in accordance with the present inventive subject matter.

For example, fixtures, housings, mounting structures and enclosing structures, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. patent application Ser. No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/512,653, filed on Jul. 30, 2009 (now U.S. Patent Publication No. 2010-0102697), the entirety of which is hereby incorporated by reference as if set forth in its entirety;

U.S. patent application Ser. No. 12/469,819, filed on May 21, 2009 (now U.S. Patent Publication No. 2010-0102199), the entirety of which is hereby incorporated by reference as if set forth in its entirety; and U.S. patent application Ser. No. 12/469,828, filed on May 21, 2009 (now U.S. Patent Publication No. 2010-0103678), the entirety of which is hereby incorporated by reference as if set forth in its entirety.

Some embodiments in accordance with the present inventive subject matter include one or more lenses or diffusers. Persons of skill in the art are familiar with a wide variety of lenses and diffusers, and can readily envision a variety of materials out of which a lens or a diffuser can be made, and are familiar with and/or can envision a wide variety of shapes that lenses and diffusers can be. Any of such materials and/or shapes can be employed in a lens and/or a diffuser in an embodiment that includes a lens and/or a diffuser. As will be understood by persons skilled in the art, a lens or a diffuser in a lighting device according to the present inventive subject matter can be selected to have any desired effect on incident light (or no effect), such as focusing, diffusing, etc.

In embodiments in accordance with the present inventive subject matter that include a diffuser (or plural diffusers), the diffuser (or diffusers) can be positioned in any suitable location and orientation.

In embodiments in accordance with the present inventive subject matter that include a lens (or plural lenses), the lens (or lenses) can be positioned in any suitable location and orientation.

In some embodiments according to the present inventive subject matter, including some embodiments that include or do not include any of the features as discussed above, the lighting device further comprises circuitry that delivers current from at least one energy source to the light source (or sources).

In some lighting devices according to the present inventive subject matter, there are further included one or more circuitry components, e.g., drive electronics for supplying and controlling current passed through the light source (or sources) in the lighting device. Persons of skill in the art are familiar with a wide variety of ways to supply and control the current passed through light sources, e.g., solid state light emitters, and any such ways can be employed in the devices of the present inventive subject matter. For example, such circuitry can include at least one contact, at least one leadframe, at least one current regulator, at least one power control, at least one voltage control, at least one boost, at least one capacitor and/or at least one bridge rectifier, persons of skill in the art being familiar with such components and being readily able to design appropriate circuitry to meet whatever current flow characteristics are desired. For example, circuitry that may be used in practicing the present inventive subject matter is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety.

The lighting devices according to the present inventive subject matter can further comprise any suitable electrical connector, a wide variety of which are familiar to those of skill in the art, e.g., an Edison connector (for insertion in an Edison socket), a GU-24 connector, etc., or may be directly wired to an electrical branch circuit.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a branch circuit, etc.). Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety.

Energy can be supplied to the at least one light source from any source or combination of sources, for example, the grid (e.g., line voltage), one or more batteries, one or more photovoltaic energy collection device (i.e., a device that includes one or more photovoltaic cells that convert energy from the sun into electrical energy), one or more windmills, etc.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 2:
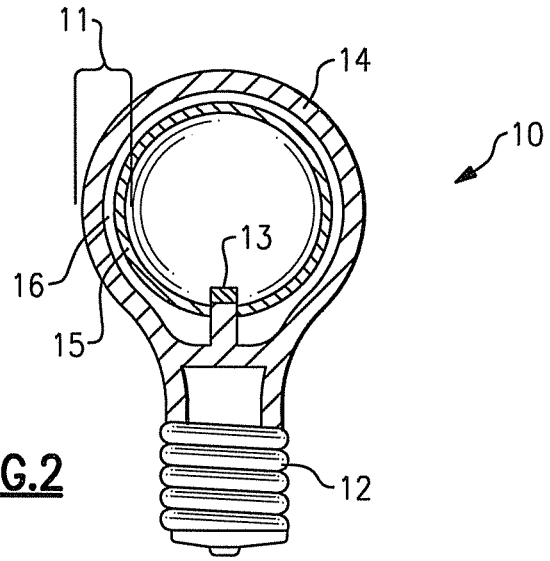

FIGS. 1-2 illustrate a lighting device 10 in accordance with the present inventive subject matter. FIG. 1 is a front view of the lighting device 10. FIG. 2 is a sectional view of the lighting device 10 taken along the plane 2-2.

Referring to FIG. 2, the lighting device 10 comprises a heat dissipation element 11, an Edison connector 12 and a light source 13. The heat dissipation element 11 comprises a first substantially transparent region 14, a second substantially transparent region 15, and a space 16 positioned therebetween. As seen in FIG. 2, the shape of an inner periphery of the first substantially transparent region 14 is substantially similar to a shape of an outer periphery of the second substantially transparent region 15. A fluid (e.g., a mixture of liquid water and water vapor) is positioned in the space 16. Optionally, if desired, one or more spacers (not shown) can be positioned between the first substantially transparent region 14 and the second substantially transparent region 15. A portion of the inside surface of the first substantially transparent region 14 is textured, grooved, roughened, treated or shaped to assist in moving the fluid, as is a portion of the outside surface of the second substantially transparent region 15. When the light source 13 is illuminated, the light it emits that exits the lighting device 10 all passes through the second substantially transparent region 15, the space 16 and the first substantially transparent region 14. A cross-section (not shown) of the heat dissipation element 11 taken along the plane 17-17 would comprise an outer substantially annular portion and an inner substantially annular portion, the inner substantially annular portion being surrounded by the outer substantially annular portion. One or more scattering agents and/or one or more luminescent materials can be positioned within the first substantially transparent region 14 and/or the second substantially transparent region 15. Either or both of the first and second substantially transparent regions can comprise at least one material selected from among silicon carbide, diamond, glass, polymeric material and ceramic material.

If desired, the heat dissipation element 11 can further comprise one or more additional layers (i.e., in addition to the first substantially transparent region 14 and the second substantially transparent region 15) and one or more additional spaces (defined by either of the first substantially transparent region 14 and the second substantially transparent region 15 and one or more of the "additional" layers, or defined by two or more of the "additional layers". The one or more additional layers can have a shape that is substantially similar to a shape of either of the first substantially transparent region 14 and the second substantially transparent region 15, or not. One example could be a device as shown in FIG. 2, but further comprising another layer between the first substantially transparent region 14 and the second substantially transparent region 15, and spaced from each of the first substantially transparent region 14 and the second substantially transparent region 15.

Figure 3:
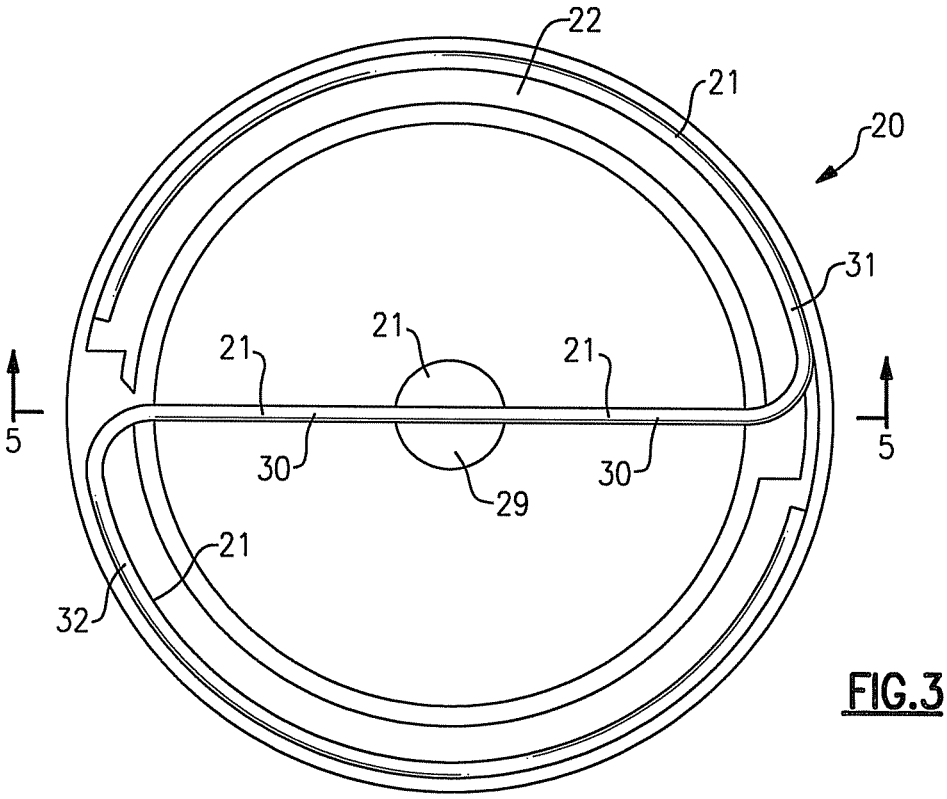
Figure 4:
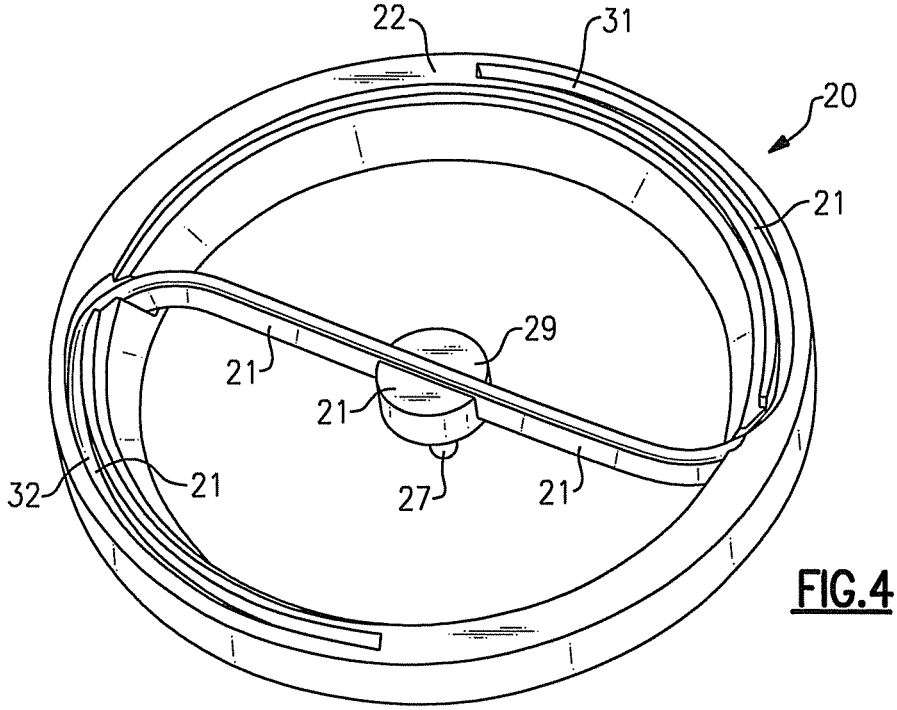
Figure 5:
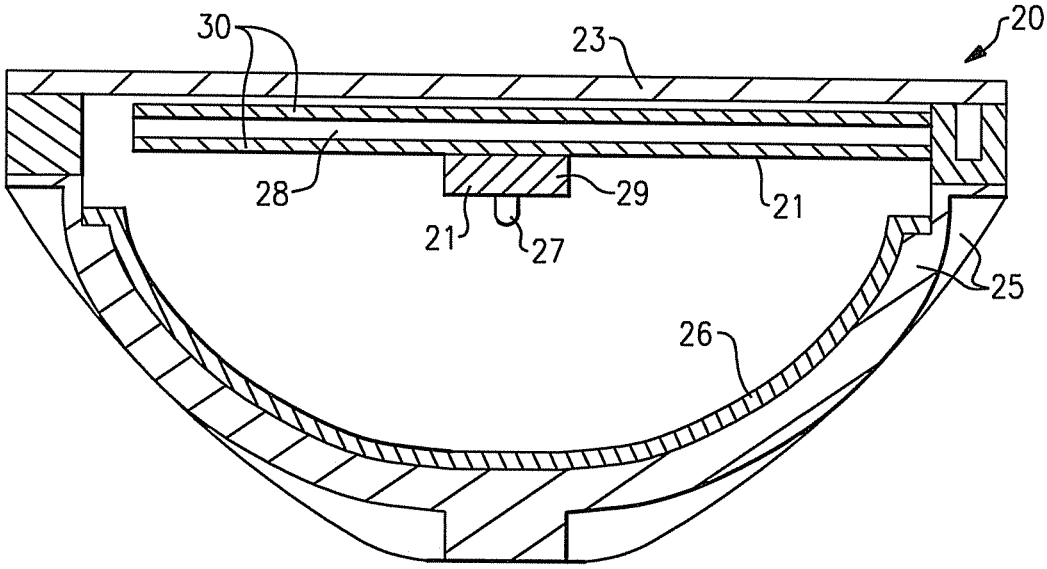

FIGS. 3-5 illustrate a lighting device 20 in accordance with the present inventive subject matter. FIG. 3 is a top view of the lighting device 20. FIG. 4 is a perspective view of the lighting device 20. FIG. 5 is a cross-sectional view taken along the plane 5-5 shown in FIG. 3.

The lighting device 20 is a back-reflector type device, and comprises a heat dissipation element 21, a rim 22, a lens 23, a housing 25, a reflector 26 (alternatively, there can be provided a plurality of reflective elements) and a light source 27. The rim 22 defines a substantially circular aperture through which light exiting the lighting device 20 exits.

The heat dissipation element 21 comprises a first portion 29 (on which the light source 27 is mounted), a second portion 30 that extends across the lighting device and third and fourth portions 31 and 32 that are in contact with the rim 22.

In the illustrated lighting device 20, the first portion 29 is substantially transparent and substantially circular and is near the center of the lighting device (as seen in FIG. 3). The second portion 30 can be diametrical relative to the substantially circular rim 22. The second portion 30 is substantially transparent, and can be pipe-shaped (e.g., hollow cylindrical, whereby a cross-section (not shown) of the second portion 30 of the heat dissipation element 21 would be substantially circular annular), defining an internal space 28 in which a fluid is positioned. The third and fourth portions 31 and 32 are partial circumferential (i.e., they define part of a circumference, i.e., a perimeter of any shape) and can be pipe-shaped, defining internal regions that can communicate with the internal space 28 (or it can instead be solid, or of any other suitable cross-section). The third and fourth portions 31 and 32 of the heat dissipation element 21 can be substantially transparent or can be partially opaque or substantially opaque. The third and fourth portions 31 and 32 can comprise a material with good thermal conductivity (e.g., having a heat conductivity of at least 1 W/m-K), which can be the same material as the first portion and/or the second portion of the heat dissipation element 21, or can be a different material.

The light source 27 is mounted on the first portion 29 (which functions as a support for the light source 27), and the first portion 29 is in direct contact with only the heat dissipation element 21 and the light source 27.

In the lighting device 20, the third and fourth portions 31 and 32 of the heat dissipation element 21 are each in thermal contact with the rim 22, each being snugly fitted in respective grooves in the rim 22, such that each of the third and fourth portions 31 and 32 are in contact with the rim 22 on an inside surface, an outside surface and a bottom surface.

The third and fourth portions 31 and 32 of the heat dissipation element 21 each extend substantially circumferentially along the substantially circular substantially annular shape, i.e., the rim 22, for about 170 degrees around the circumference of the rim 22. The third and fourth portions 31 and 32 each extend in the same circumferential direction, i.e., counter-clockwise as seen from above in FIG. 3.

The first portion 29 of the heat dissipation element 21 is in thermal contact with the second portion 30 of the heat dissipation element 21. The first portion 29 of the heat dissipation element 21 comprises a groove, and a portion of the second portion 30 of the heat dissipation element 21 extends along the groove.

The light source 27 can be a light emitting diode (or a plurality of light emitting diodes) or any other suitable light source. The light source 27 can be replaced with any other suitable kind of light source, or with a plurality of any kind of light sources, or with one or more of each of a plurality of different kinds of light sources.

If desired, the heat dissipation element 21 can further comprise one or more additional layers. For example, one or more additional pipe-shaped element(s) can be provided around the second portion 30 (e.g., the additional pipe-shaped element (s) can be larger than, spaced from and coaxial with the second portion 30). One or more additional spaces can be defined, e.g., between the second portion 30 and one or more of the "additional" layers, or defined by two or more of the "additional layers". The one or more additional layers can be of a shape that is substantially similar to a shape of one or more other portion(s) of the heat dissipation element 21, or not.

Figure 6:
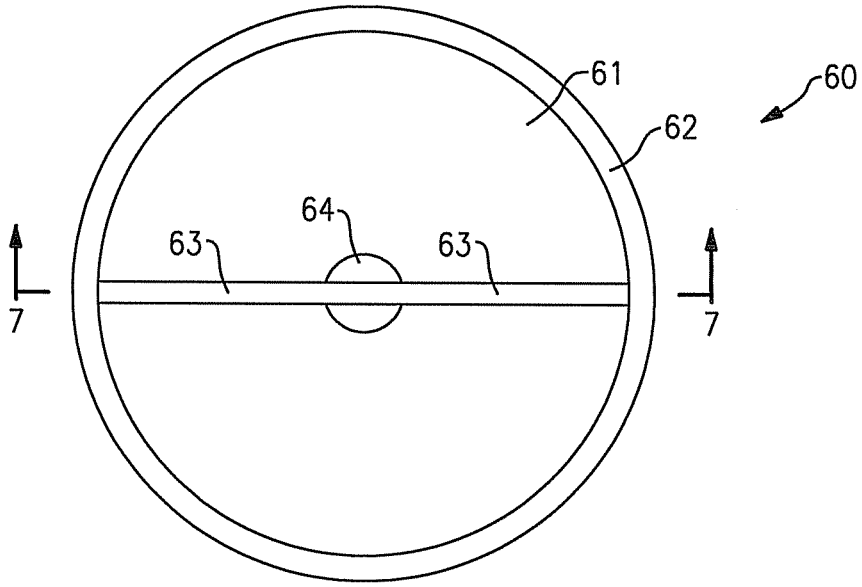
Figure 7:
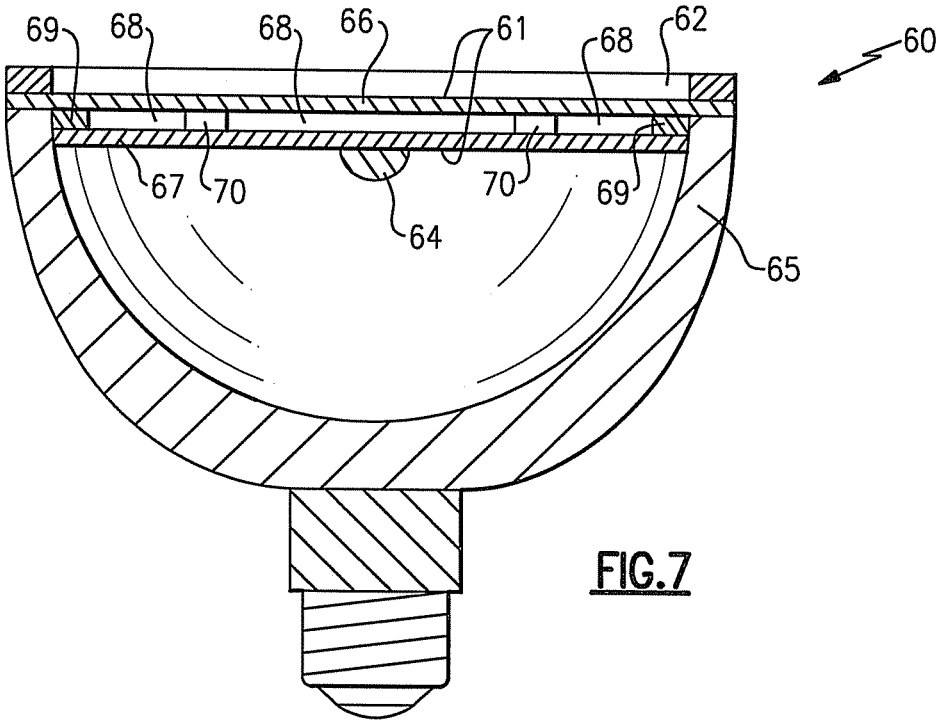

FIGS. 6-7 illustrate a lighting device 60 in accordance with the present inventive subject matter. FIG. 6 is a top view of the lighting device 60. FIG. 7 is a sectional view of the lighting device 60 taken along the plane 7-7.

Referring to FIG. 6, the lighting device 60 comprises a lens 61 which functions as a heat dissipation element, a rim 62, a conductive trace 63, a light source 64, and a housing 65.

The lens 61 covers an aperture defined by the housing 65, and the lens 61 comprises a first substantially transparent element 66 and a second substantially transparent element 67, the first substantially transparent element 66 and the second substantially transparent element 67 defining a space 68 therebetween. A fluid is positioned in the space 68. There is also provided a peripheral element 69 that retains the fluid in the space 68, and one or more spacers 70. The peripheral element 69 and/or the spacer(s) 70 can be substantially transparent, or substantially reflective, or opaque. All of the light emitted by the light source 64 that exits the lighting device passes through the lens 61.

The lens 61 (A) can be entirely made of the first substantially transparent element 66 and the second substantially transparent element 67 (and optionally the peripheral element 69 and/or one or more spacers 70), or (B) parts of the lens 61 can be made of the first substantially transparent element 66 and the second substantially transparent element 67, and one or more other portions of the lens 61 can be of a different structure (which can be substantially transparent or not).

Figure 8:
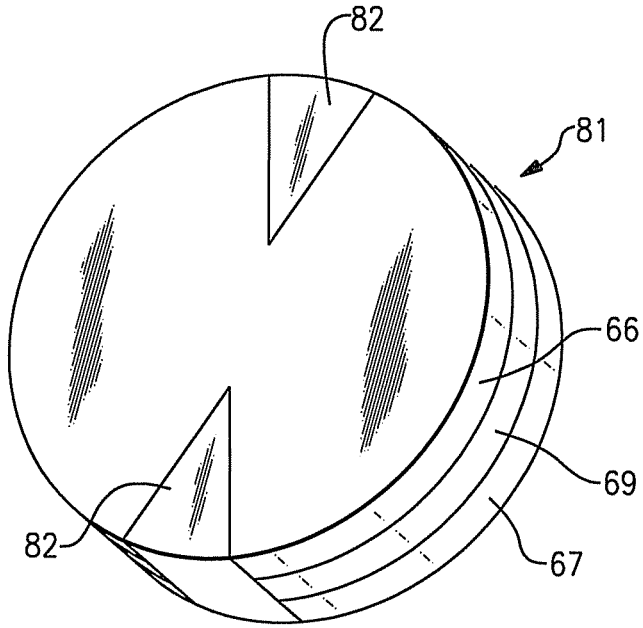
FIG. 8 depicts an alternative lens according to the present inventive subject matter, for use in lighting devices according to the present inventive subject matter.

For example, FIG. 8 depicts an alternative lens 81 that includes a first substantially transparent element 66, a second substantially transparent element 67 (a space being defined between portions of the first substantially transparent element 66 and the second substantially transparent element 67) and a peripheral element 69, as well as regions 82 made of glass (or some other substantially transparent material).

Figure 9:
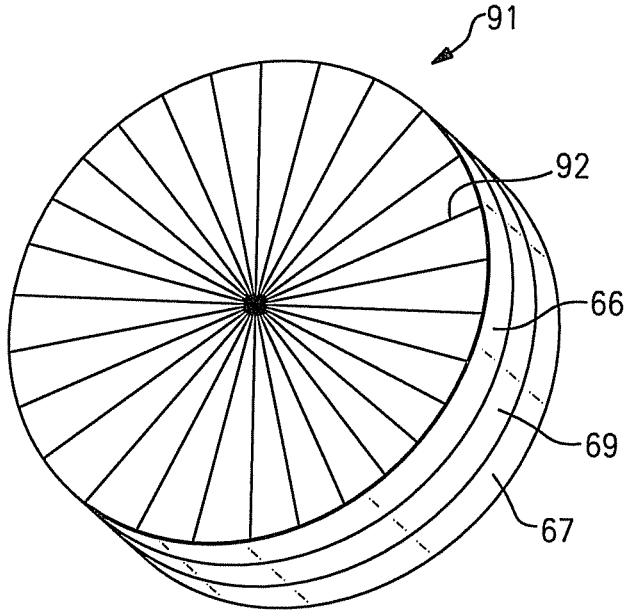
FIG. 9 depicts an alternative lens according to the present inventive subject matter, for use in lighting devices according to the present inventive subject matter.

For another example, FIG. 9 depicts an alternative lens 91 that includes a first substantially transparent element 66, a second substantially transparent element 67 (a space being defined between portions of the first substantially transparent element 66 and the second substantially transparent element 67) and a peripheral element 69, as well as wires 92 made of copper (or some other material with high heat conductivity).

Figure 10:
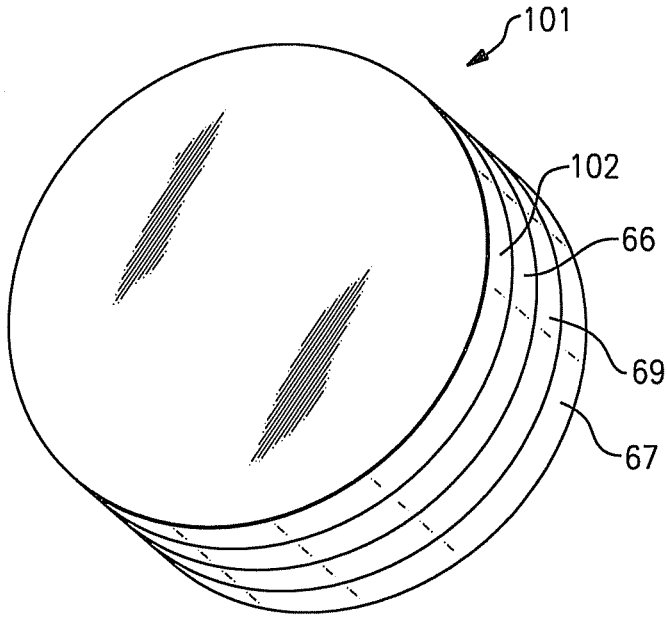
FIG. 10 depicts an alternative lens according to the present inventive subject matter, for use in lighting devices according to the present inventive subject matter.

For another example, FIG. 10 depicts an alternative lens 101 that includes a first substantially transparent element 66, a second substantially transparent element 67 (a space being defined between portions of the first substantially transparent element 66 and the second substantially transparent element 67) and a peripheral element 69, as well as a layer 102 made of glass (or some other substantially transparent material).

Referring again to FIG. 6, the rim 62 extends around a periphery of the lens 61 and can be made of a material of good thermal conductivity (e.g., having a heat conductivity of at least 1 W/m-K). The rim 62 assists in uniformly spreading heat to be dissipated from the housing 65.

The conductive traces 63 provide power to the light source 64. In some embodiments, the conductive traces 63 can be formed of a substantially transparent material or a partially transparent material. Alternatively, rather than being on a top surface of the lens 61, conductive traces 63 can be incorporated in the lens 61 or positioned on the opposite side of the lens 61, and/or power can be supplied to the light source 64 in any other suitable way.

The light source 64 can be a light emitting diode (or a plurality of light emitting diodes) or any other suitable light source. The light source 64 can be replaced with any other suitable kind of light source, or with a plurality of any kind of light sources, or with one or more of each of a plurality of different kinds of light sources.

The housing 65 has a reflective surface facing the light source 64 (and/or a reflective layer can be positioned on the housing 65).

When the light source 64 is illuminated, at least some of the light it emits that exits the lighting device 60 passes through the second substantially transparent region 67, the space 68 and the first substantially transparent region 66.

The light source 64 is in direct contact with only the second substantially transparent region 67 of the lens 61 and the conductive traces 63.

An axis of the space 68 (i.e., any line along its plane of symmetry) defines an angle of not more than 70 degrees (i.e., about 0 degrees) relative to the emission plane of the light source 64. As noted above, "emission plane" means (1) a plane that is perpendicular to an axis of the light emission from the light source 64 (e.g., in a case where light emission is hemispherical, the plane would be along the flat part of the hemisphere; in a case where light emission is conical, the plane would be perpendicular to the axis of the cone), (2) a plane that is perpendicular to a direction of maximum intensity of light emission from the light source 64 (e.g., in a case where the maximum light emission is vertical, the plane would be horizontal), or (3) a plane that is perpendicular to a mean direction of light emission.

The top and bottom surfaces of the first substantially transparent region 66 are substantially planar and substantially parallel to the top and bottom surfaces of the second substantially transparent region 67.

A portion of the first substantially transparent region 66 and/or a portion of the second substantially transparent region 67 can be textured, grooved, roughened, treated or shaped to assist in moving the fluid.

If desired, the lens 61 can further comprise one or more additional layers (i.e., in addition to the first substantially transparent element 66 and the second substantially transparent element 67), and one or more additional spaces (defined by either of the first substantially transparent element 66 and the second substantially transparent element 67 and one or more of the "additional" layers, or defined by two or more of the "additional layers". The one or more additional layers can have a shape that is substantially similar to a shape of either of the first substantially transparent element 66 and the second substantially transparent element 67, or not. One example could be a device as shown in FIG. 7, but further comprising another layer between the first substantially transparent element 66 and the second substantially transparent element 67, and spaced from each of the first substantially transparent element 66 and the second substantially transparent element 67.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.).

The invention claimed is:

1. A lighting device comprising:

at least a first light source; and at least a first heat dissipation element comprising at least first and second substantially transparent regions and at least a first fluid, at least a first space defined between the first substantially transparent region and the second substantially transparent region, at least some of the first fluid in the first space, at least a first portion of the first fluid is liquid, and at least a second portion of the first fluid is gaseous.

2. A lighting device as recited in claim 1, wherein substantially all light emitted by the first light source that exits the lighting device passes through at least a portion of the first heat dissipation element.

3. A lighting device as recited in claim 1, wherein substantially all of the first heat dissipation element is substantially transparent.

4. A lighting device as recited in claim 1, wherein the first light source is in direct contact with only the first heat dissipation element and at least one power line.

5. A lighting device as recited in claim 1, wherein the first heat dissipation element comprises an inner wall and an outer wall, and at least a portion of the first space is positioned between the inner wall and the outer wall.

6. A lighting device as recited in claim 1, wherein at least one cross-section of the first heat dissipation element comprises an outer substantially annular portion and an inner substantially annular portion, the inner substantially annular portion surrounded by the outer substantially annular portion.

7. A lighting device as recited in claim 1, wherein the first light source is mounted on a support, and the support is in direct contact with only at least one heat dissipation element and at least one light source.

8. A lighting device as recited in claim 1, wherein the lighting device further comprises at least a first reflector, and at least some light emitted by the first light source that exits the lighting device is reflected by the first reflector before exiting the lighting device.

9. A lighting device as recited in claim 1, wherein the lighting device further comprises at least a first back-reflector, and substantially all light emitted by the first light source that exits the lighting device is reflected before exiting the lighting device.

10. A lighting device as recited in claim 9, wherein the first back-reflector defines an aperture through which light exiting the lighting device exits, and the first heat dissipation element extends across the aperture from a first portion of the first back-reflector to a second portion of the first back-reflector.

11. A lighting device as recited in claim 10, wherein the aperture is substantially circular, and the first heat dissipation element is substantially diametrical relative to the aperture.

12. A lighting device as recited in claim 9, wherein the first back-reflector comprises a plurality of reflective elements.

13. A lighting device as recited in claim 1, wherein an axis of at least a portion of the space defines an angle of not more than 70 degrees relative to an emission plane of the first light source.

14. A lighting device as recited in claim 1, wherein the first light source comprises at least one solid state light emitter.

15. A lighting device as recited in claim 1, wherein the first light source is in contact with the first heat dissipation element.

16. A lighting device as recited in claim 1, wherein at least one of the first and second substantially transparent regions comprises at least one material selected from among scattering agents and luminescent materials.

17. A lighting device as recited in claim 1, wherein at least one of the first and second substantially transparent regions comprises at least one material selected from among silicon carbide, diamond, glass, polymeric material and ceramic material.

18. A lighting device as recited in claim 1, wherein at least a first cross-section of the first heat dissipation element is substantially annular.

19. A lighting device as recited in claim 1, wherein the first heat dissipation element comprises at least one opaque region.

20. A lighting device as recited in claim 1, wherein a shape of an inner periphery of the first substantially transparent region is substantially similar to a shape of an outer periphery of the second substantially transparent region.

21. A lighting device as recited in claim 1, wherein a first surface of the first substantially transparent region is substantially planar and substantially parallel to a first surface of the second substantially transparent region.

22. A lighting device as recited in claim 1, wherein a portion of the first substantially transparent region is textured, grooved, roughened, treated or shaped to assist in moving the fluid.

23. A lighting device as recited in claim 22, wherein a portion of the second substantially transparent region is textured, grooved, roughened, treated or shaped to assist in moving the fluid.

24. A lighting device as recited in claim 1, wherein the first heat dissipation element comprises at least a first reflective region.

25. A lighting device comprising:

at least a first light source; and at least a first heat dissipation element, said first heat dissipation element comprising at least a first enclosed space through which at least some light emitted by the first light source passes and at least a first fluid in the first enclosed space, all of the first enclosed space accessible to the first fluid, at least a first portion of the first fluid being liquid, at least a second portion of the first fluid being gaseous, the first light source in direct contact with only the first heat dissipation element and at least one power line.

26. A lighting device as recited in claim 25, wherein substantially all light emitted by the first light source that exits the lighting device passes through at least a portion of the first enclosed space.

27. A lighting device as recited in claim 25, wherein the lighting device further comprises at least a first reflector, and at least some light emitted by the first light source that exits the lighting device is reflected by the first reflector before exiting the lighting device.

28. Alighting device as recited in claim 25, wherein the lighting device further comprises at least a first back-reflector, and substantially all light emitted by the first light source that exits the lighting device is reflected before exiting the lighting device.

29. A lighting device as recited in claim 28, wherein the first back-reflector comprises a plurality of reflective elements.

30. A lighting device as recited in claim 25, wherein an axis of at least a portion of the space defines an angle of not more than 70 degrees relative to an emission plane of the first light source.

31. A lighting device as recited in claim 25, wherein the first light source comprises at least one solid state light emitter.

32. A lighting device comprising:

at least a first light source;

and heat conducting means for dissipating heat, the heat conducting means for dissipating heat comprising at least first and second substantially transparent regions and at least a first fluid, at least a first space defined between the first substantially transparent region and the second substantially transparent region, at least some of the first fluid in the first space, at least a first portion of the first fluid is liquid, and at least a second portion of the first fluid is gaseous.

33. A lighting device comprising:

at least a first light source;

and at least a first heat dissipation element comprising at least first and second substantially transparent regions and at least a first fluid, at least a first space coupled with the first substantially transparent region and the second substantially transparent region, at least some of the first fluid in the first space, at least a first portion of the first fluid is liquid, and at least a second portion of the first fluid is gaseous.

34. A lighting device as recited in claim 33, wherein substantially all light emitted by the first light source that exits the lighting device passes through at least a portion of the first heat dissipation element.

35. A lighting device as recited in claim 33, wherein substantially all of the first heat dissipation element is substantially transparent.

36. A lighting device comprising:

at least a first light source; and at least a first heat dissipation element comprising at least a first heat pipe, the first heat pipe comprising at least one substantially transparent region, at least a portion of light emitted by the first light source that exits the lighting device passes from a first side of a first substantially transparent region of the first heat pipe through the first substantially transparent region to a second side of the first substantially transparent region, then through a space defined at least in part between the first substantially transparent region and a second substantially transparent region of the first heat pipe, and then through the second substantially transparent region.

37. A lighting device as recited in claim 36, wherein substantially all light emitted by the first light source that exits the lighting device passes through at least a portion of the first heat pipe.

38. A lighting device as recited in claim 36, wherein substantially all light emitted by the first light source that exits the lighting device passes through at least a portion of the first heat dissipation element.

39. A lighting device as recited in claim 36, wherein substantially all of the first heat dissipation element is substantially transparent.

40. A lighting device as recited in claim 36, wherein substantially all of the first heat pipe is substantially transparent.

41. A lighting device as recited in claim 36, wherein the lighting device further comprises at least a first reflector, and substantially all light emitted by the first light source that exits the lighting device is reflected before exiting the lighting device.

42. A lighting device as recited in claim 25, wherein:

the heat dissipation element comprises at least a first region and a second region, the first region comprises at least a first surface and a second surface, the second region comprises at least a third surface and a fourth surface, the second surface and the third surface face each other and are substantially parallel to each other, the first enclosed space is between the second surface and the third surface.

* * * * *